United States Patent [19]

Tsai et al.

[11] Patent Number: 4,607,679

[45] Date of Patent: Aug. 26, 1986

[54] PROVIDING OLIGOMER MOISTURE BARRIER IN DIRECT CHILL CASTING OF ALUMINUM-LITHIUM ALLOY

[75] Inventors: Mei-Yuan Tsai; John E. Jacoby; Joseph T. Laemmle, all of Murrysville, Pa.

[73] Assignee: Aluminum Company of America, Pittsburgh, Pa.

[21] Appl. No.: 679,135

[22] Filed: Dec. 6, 1984

[51] Int. Cl.[4] ..... B22D 11/04; B22D 11/07

[52] U.S. Cl. ..... 164/5; 164/128; 164/472; 164/487

[58] Field of Search ..... 164/472, 487, 486, 128, 164/5

[56] References Cited

U.S. PATENT DOCUMENTS

| | | | |
|---|---|---|---|
| 2,515,284 | 7/1950 | Zeigler et al. | 164/487 |
| 3,034,186 | 5/1962 | Holshouser . | |
| 3,253,932 | 5/1966 | White et al. . | |
| 3,381,741 | 5/1968 | Gardner . | |
| 3,503,770 | 3/1970 | Guillet et al. . | |
| 3,524,751 | 8/1970 | Smith . | |
| 3,763,244 | 10/1973 | Shubkin . | |
| 4,000,625 | 1/1977 | Beerens et al. | 164/486 X |
| 4,157,728 | 6/1979 | Mitamura et al. . | |
| 4,265,663 | 5/1981 | Gilicinski et al. . | |
| 4,282,392 | 8/1981 | Cupples et al. . | |
| 4,462,948 | 7/1984 | McClain . | |

FOREIGN PATENT DOCUMENTS

| | | |
|---|---|---|
| 925070 | 4/1970 | Canada . |
| 2129345A | 5/1984 | United Kingdom . |

*Primary Examiner*—Nicholas P. Godici
*Assistant Examiner*—J. Reed Batten, Jr.
*Attorney, Agent, or Firm*—Douglas G. Glantz

[57] ABSTRACT

The present invention involves a process for continuously casting a lithium-containing alloy by direct chill with a direct chill coolant and providing a moisture barrier liquid having a flash point higher than about 400° F. to reduce water absorption in the coolant. The process in one aspect includes applying the moisture barrier liquid as a mold parting composition containing less than a varnish-film forming amount of fatty esters, fatty acids, or fatty alcohols. The process is particularly useful in the direct chill casting of aluminum-lithium alloy by direct chill with ethylene glycol coolant.

5 Claims, 1 Drawing Figure

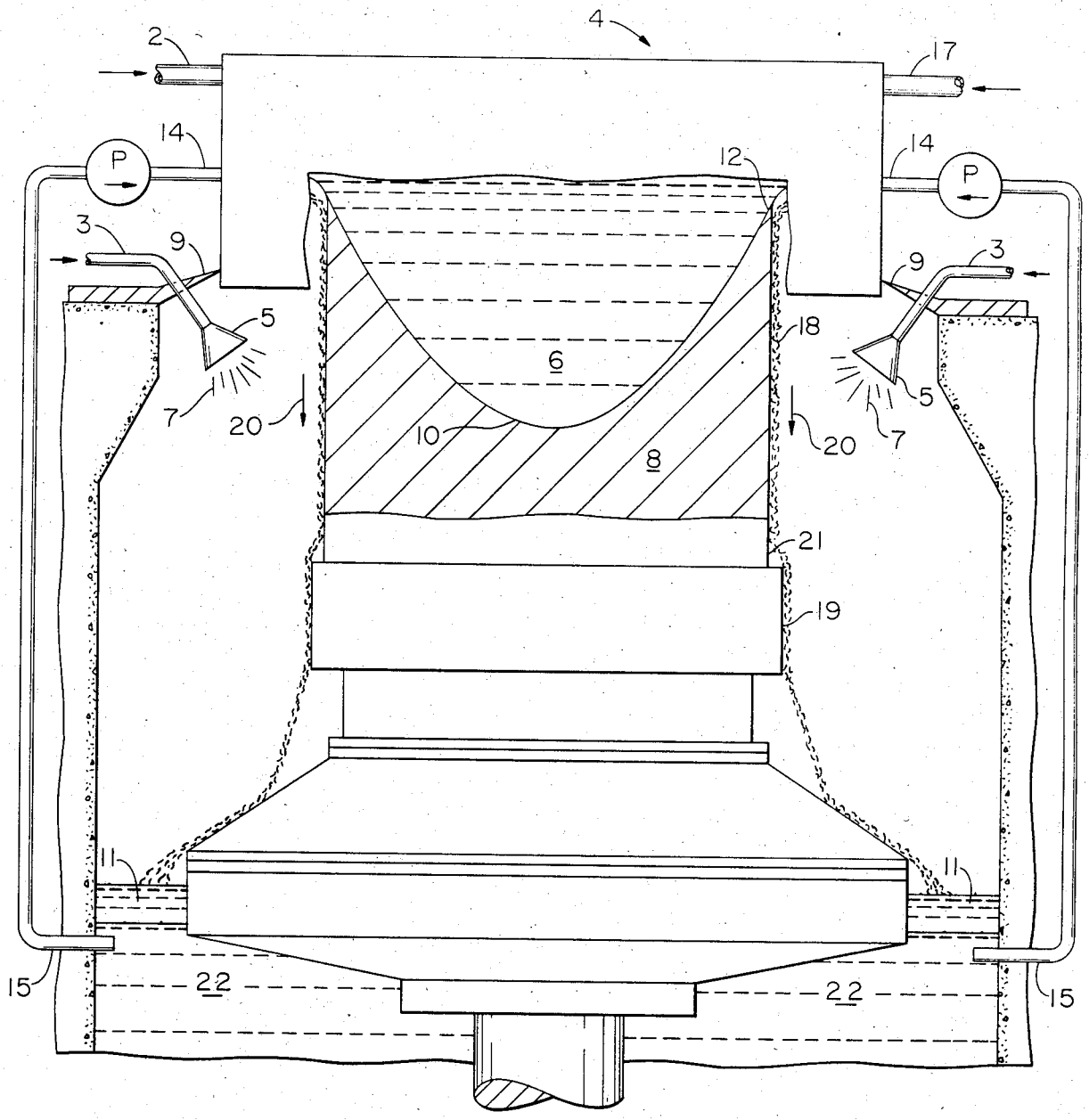
4
2
17
14
14
P
P
12
3
9
3
9
5
5
18
6
7
7
20
20
10
8
21
19
11
11
15
15
22
22

PROVIDING OLIGOMER MOISTURE BARRIER IN DIRECT CHILL CASTING OF ALUMINUM-LITHIUM ALLOY

BACKGROUND OF THE INVENTION

This invention relates to the continuous casting of lithium-containing alloy such as aluminum-lithium alloy.

SUMMARY OF THE INVENTION

This invention provides a process for direct chill casting a lithium-containing alloy including continuously casting the lithium-containing alloy by direct chill with a coolant and providing a moisture barrier liquid to reduce water absorption in the coolant. The moisture barrier liquid composition includes vegetable oils or synthetic hydrocarbons having flash points higher than about 400° F. In one aspect, the moisture barrier liquid comprises alpha-olefin oligomer.

BRIEF DESCRIPTION OF THE DRAWING

The FIGURE is an elevation view, partially in section, of a schematic apparatus for the continuous casting of molten metal through direct chill.

DETAILED DESCRIPTION

This invention provides a moisture barrier for the direct chill coolant in a direct chill continuous casting process. In casting conventional aluminum alloys, the direct chill coolant is water. However, water presents a significant risk of violent explosion when used as a direct chill coolant for the continuous casting of aluminum-lithium alloy. The explosion risk is particularly high for aluminum alloys containing lithium in an amount above about 1.5–2% by weight. Nevertheless, aluminum-lithium alloy effectively can be continuously cast using an organic composition, e.g., such as ethylene glycol, as the direct chill coolant.

Certain preferred organic casting coolants, e.g., ethylene glycol, are hygroscopic, and moisture will accumulate in the coolant, e.g., when exposed to normal atmospheric conditions. A direct chill coolant of ethylene glycol will extract moisture from the air in amounts equal to about twice its initial volume. When the absorbed water content reaches a certain level, e.g., about 5–10% by weight or more of the coolant, e.g., of the ethylene glycol, the explosion hazard returns.

The present invention provides a process for inhibiting the extraction of water from the air into the direct chill coolant. The process of the present invention includes a moisture barrier liquid which substantially covers the coolant and which is impervious to water. The moisture barrier liquid is immiscible with the coolant so that the moisture barrier liquid does not become inseparably mixed with the direct chill coolant. The moisture barrier liquid has a high flash point, i.e., higher than about 400° F. and preferably higher than about 500° F., thereby preventing fires when bleedouts pass molten metal through the ingot solid surface. The moisture barrier liquid provides a high density difference over the coolant resulting in superior gravimetric separation. The moisture barrier liquid has a low functionality such that ion-dipole, dipole-dipole, or hydrogen bonding is reduced.

The composition for providing a moisture barrier liquid in the process of the present invention can be selected from base stocks including vegetable oils such as triglycerides or triglyceride blends having flash points greater than 400° F. and preferably greater than 500° F., e.g., glycerol trioleate, castor oil, and others, and synthetic hydrocarbons such as cycloaliphatics, polyalphaolefins also known as alpha-olefin oligomers or isoparaffinic oligomers, polybutenes, and alkylated benzenes having flash points higher than 400° F. and preferably higher than 500° F.

Referring now to the FIGURE, a schematic apparatus is illustrated for the purpose of describing the present invention as applied to casting an aluminum alloy containing lithium. Molten metal at about 1320° F. is passed in line 2 through direct chill casting device 4 to interior 6 of ingot 8. Interior 6 includes a molten pool having solidus line 10 which forms initially as a solid shell 12 in a solidus temperature, e.g., on the order of about 1100° F. Coolant at a temperature substantially below 1100° F. is passed in line 14 to casting device 4 which is adapted to place the coolant in thermal contact, such as including but not limited to heat transfer through a mold surface (not shown), such that molten metal 6 is continuously cast as shell 12.

Starting block 19 initially is placed directly under or inside casting device 4 to form a base 21 of ingot 8. Starting block 19 then is withdrawn to a position under the casting device (as shown) thereby permitting a continuous casting process. Shell 12 grows in thickness while ingot 8 is cooled by direct chill. Coolant at a temperature, by way of example, of about 120° F. is applied at 18 to the surface of shell 12 of the continuously forming ingot. Coolant liquids flow down the solid surface of the ingot as indicated by directional arrow 20, and ingot 8 is cooled by direct contact or direct chill. Coolant increases in temperature as it flows down the solid ingot surface. Warmed coolant separates from the ingot by falling into the casting pit where it collects as a pool or reservoir 22.

A moisture barrier liquid 11 of a high flash point vegetable oil or synthetic hydrocarbon, e.g., such as, alpha-olefin oligomer having a flash point of about 525° F., is placed on the surface of coolant liquid in reservoir 22. The alpha-olefin oligomer is substantially immiscible and of low specific gravity relative to the coolant liquid, e.g., ethylene glycol, so that the moisture barrier will collect on the surface of coolant pool 22.

Coolant is recirculated in line 15 from reservoir 22 to join line 14.

Alpha-olefin oligomer is passed in line 17 to direct chill casting device 4 and is applied to the mold as parting composition. The alpha-olefin oligomer incorporated as parting composition lubricates the mold to reduce the friction between the mold and the thin moving ingot shell as illustrated by shell 12 in the FIGURE. Otherwise, the continuously forming ingot would tear on the mold surface. Such tears not only are defects on the ingot surface but also facilitate bleedouts of molten metal in direct contact with coolant. Such bleedouts are to be avoided particularly in casting lithium-containing alloys.

Moisture barrier 11 of immiscible fluid containing alpha-olefin oligomer lubricant is provided on the coolant in the reservoir, e.g., by floating the oligomer having a density less than the coolant. Barrier layer 11 acts as a substantially impermeable barrier to moisture absorption by the ethylene glycol. However, it is impractical to prevent some moisture pickup during casting and holding of the coolant in the direct chill process, and the coolant can be dried by many different drying techniques such as sparging. The moisture content of the coolant should be controlled to maintain a preferred level, such as within a predetermined range of water content in the coolant.

Aluminum-lithium alloy having a lithium content on the order of about 1.2% by weight lithium (Aluminum Association Alloy 2020) conventionally has been cast in a continuous ingot by direct chill with water, i.e., substantially 100% water. However, molten aluminum-lithium alloy containing even slightly higher amounts of lithium, such as about 1.5% to 2% or higher amounts by weight lithium, can react with a violent reaction or explosion when brought into direct contact with water or water/glycol mixtures as may occur with the bleed-out during continuous direct chill casting process.

The process of the present invention avoids such a violent reaction and maintains a moisture barrier over the coolant in the reservoir of the casting pit. The process of the present invention thereby holds the moisture or water content in the organic coolant below a predetermined level to prevent explosive reaction when direct chill casting lithium-containing alloys having more than about 1.5% by weight lithium.

The process of the present invention in one embodiment applies the moisture barrier liquid, e.g., alpha-olefin oligomer as the parting composition or mold lubricant.

Alpha-olefin oligomer as used herein is formed by polymerization, e.g., specifically in a process called oligomerization, according to the following sequence of carefully controlled chemical reactions.

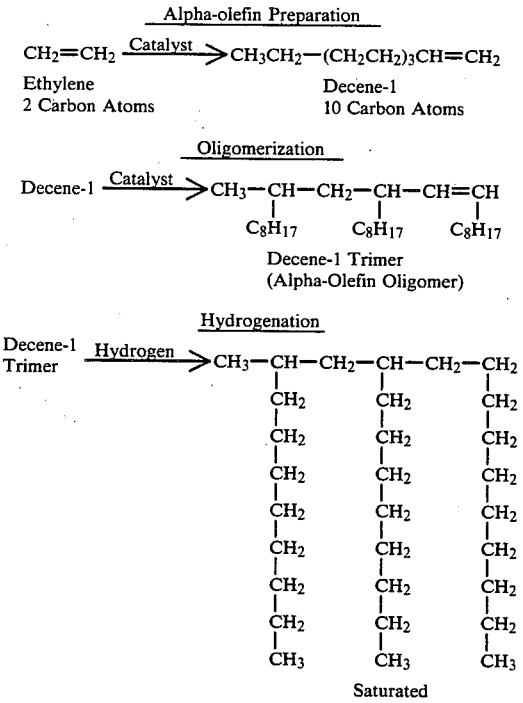

Closely controlling the conditions of the polymerization reaction yields synthetic oils which substantially conform to one structure. Physical properties of the resulting oil are fairly constant and predictable. The preceding diagrams use decene-1 as the starting raw material. Suitable alpha-olefin oligomers are also manufactured by way of example by mixtures of C-3–C-10 alpha-olefin monomers of 6–16 carbon atoms. Alpha-olefin oligomers are available commercially from Gulf Oil Company as Synfluid, i.e., under the trade name Synfluid, from Bray Oil Company as PAOL, from Mobil as Mobil SHF, from Emery Industries as Poly-x-olefin, and from Ethyl Corporation.

The moisture barrier and parting composition of the present invention can be formed from a blend of two or more alpha-olefin oligomers. Preferably, the alpha-olefin oligomer or oligomer blend has a viscosity in the range of about 1–3 cs at 450° F. The composition's viscosity at 450° F. is determined by the method published in ASTM D445. Below about 1 centistoke, the oligomer or oligomer blend does not provide adequate lubrication without substantial increases in the rate of flow. Above about 3 centistokes, the oligomer or oligomer blend retards heat transfer from the molten metal to the mold.

The moisture barrier and parting composition combination of the present invention contains less than a varnish-film forming amount of fatty ester, fatty acid, or fatty alcohol. Fatty esters such as triglycerides and including castor oil will form varnish-like films when in contact with the lithium-containing alloy. Preferably, the moisture barrier and parting composition should contain less than about 20% by weight triglycerides. More preferably, the moisture barrier and parting composition contains less than about 5% by weight triglycerides. In the most preferred embodiment, the moisture barrier and parting composition of the present invention is substantially free from triglycerides.

While the invention has been described in terms of preferred embodiments, the claims appended hereto are intended to encompass other embodiments which fall within the spirit of the invention.

What is claimed is:

1. A process for continuously casting an aluminum alloy containing more than about 1.5% by weight lithium into a solidified ingot having a smallest transverse dimension greater than about 6 inches, comprising:

initiating solidification of aluminum-lithium alloy into an ingot in a continuous casting mold;

direct chill cooling said ingot with a coolant comprising an organic coolant and a moisture content less than an amount predetermined to avoid explosions, said coolant being applied to the surface of said ingot and separating therefrom:

collecting said coolant separating from said ingot in a collection pool:

providing a moisture barrier liquid containing alpha-olefin oligomer to reduce moisture absorption in the coolant; and recirculating said coolant from the collection pool for further direct chill cooling.

2. A process as set forth in claim 1 wherein said alpha-olefin oligomer has a viscosity in the range of about 1–3 centistokes at 450° F. and said process further comprises applying the alpha-olefin oligomer as a parting composition to the mold.

3. A process as set forth in claim 2 wherein said moisture barrier liquid contains less than a varnish-film forming amount of triglycerides.

4. A process as set forth in claim 3 wherein said moisture barrier liquid contains less than about 5% by weight triglycerides.

5. A process as set forth in claim 4 wherein said moisture barrier liquid is substantially free from triglycerides.

* * * * *